US006162269A

United States Patent [19]

Greenlees et al.

[11] Patent Number: 6,162,269

[45] Date of Patent: Dec. 19, 2000

[54] FILTER ASSEMBLY FOR CLEANING COOLING AIR FOR ENGINES

[75] Inventors: Roy E. Greenlees, Lake Forest, Ill.; Richard Snyder, Gary, Ind.; Kenneth S. Schultz, Evanston; R. Ryan Greenlees, Lake Forest, both of Ill.

[73] Assignee: United Air Filter, Inc., Cicero, Ill.

[21] Appl. No.: 09/299,320

[22] Filed: Apr. 26, 1999

Related U.S. Application Data

[63] Continuation-in-part of application No. 09/240,210, Jan. 29, 1999, Pat. No. 6,022,391.

[51] Int. Cl.[7] ..... F02B 77/00

[52] U.S. Cl. ..... 55/385.1; 55/385.3; 55/DIG. 28; 123/41.65; 123/198 E

[58] Field of Search ..... 55/385.1, 385.3, 55/406, DIG. 28; 123/41.65, 41.62, 41.7, 185.4, 185.2, 198 E; 180/68.1; 56/12.8

[56] References Cited

U.S. PATENT DOCUMENTS

| | | | |
|---|---|---|---|
| 2,445,965 | 7/1948 | Packwood | 56/12.8 |
| 2,601,907 | 7/1952 | Burrows et al. | 55/406 |
| 2,736,301 | 2/1956 | Medenus | 123/41.65 |
| 2,848,987 | 8/1958 | Morden | 123/185.4 |
| 2,972,340 | 2/1961 | Bertsch | 123/41.7 |
| 3,147,814 | 9/1964 | Suhre | 180/68.1 |
| 3,183,899 | 5/1965 | Tuggle | 123/41.65 |
| 3,744,468 | 7/1973 | Braun | 123/185.2 |
| 3,994,067 | 11/1976 | Hazzard et al. | 55/385.3 |
| 4,134,370 | 1/1979 | Iwahashi et al. | 123/41.31 |
| 4,261,302 | 4/1981 | Sheldon | 123/41.7 |
| 4,438,733 | 3/1984 | Sasaki | 123/41.62 |
| 4,446,681 | 5/1984 | Dynie et al. | 123/41.65 |
| 4,770,262 | 9/1988 | Yasunaga et al. | 123/41.65 |
| 4,946,482 | 8/1990 | Tamba et al. | 55/DIG. 28 |
| 4,970,993 | 11/1990 | Weiss et al. | 123/41.7 |
| 4,998,510 | 3/1991 | Rognon | 123/41.7 |
| 5,167,209 | 12/1992 | Dufern et al. | 123/198 E |
| 6,022,391 | 2/2000 | Greenlees et al. | 55/385.1 |

*Primary Examiner*—David A. Simmons
*Assistant Examiner*—Minh-Chau T. Pham
*Attorney, Agent, or Firm*—Marshall, O'Toole, Gerstein, Murray & Borun

[57] ABSTRACT

An engine filter assembly for cleaning cooling air for an internal-combustion engine for use in high-debris environment such as in roofing-removing machines includes a filter housing attached to the machine at a remote position. The filter housing houses a two-stage air filter that consists of a cylindrical-shaped filter element with an outer pre-filter covering. Both the carburetor air inlet and a fan housing leading to the cooling fan on the engine are connected to the filter housing by tubing. A shield protects the engine from direct contact with loose or air-borne materials during the operation of the machine. A thermal sensing device reads the temperature of the engine and automatically shuts down the engine if the temperature rises beyond specification, reducing the chance of engine failure.

17 Claims, 3 Drawing Sheets

FILTER ASSEMBLY FOR CLEANING COOLING AIR FOR ENGINES

CROSS-REFERENCE TO RELATED APPLICATION

This is a continuation-in-part application of application Ser. No. 09/240,210, filed Jan. 29, 1999, now U.S. Pat. No. 6,022,391.

BACKGROUND OF THE INVENTION

This invention relates in general to protection of internal combustion engines to reduce overheating and subsequent engine failure, and more particularly to protection of small engines used in high-debris environments such as in roof-removing machines.

U.S. Pat. No. 5,167,209 illustrates such a roof-removing machine. U.S. Pat. Nos. 2,445,965; 2,601,907; 2,736,301; 2,848,987; 2,972,340; 3,147,814; 3,183,899; 3,252,449; 3,744,468; 3,994,067; 4,134,370; 4,261,302; 4,438,733; 4,446,681; 4,770,262; 4,946,482; 4,970,933; 4,998,510; and 5,167,209 illustrate various filtering arrangements for air-cooled engines.

When operated in dirty environments, such as in roof removing machines, air-cooled engines often overheat because debris drawn into the air cooling intake coats the fan blades and cooling fins, reducing heat dissipation and clogging the air intake. The reduced efficiency of the cooling system in turn causes the engine to overheat, creating a high potential for engine failure. Additionally, debris-ridden air is drawn into the carburetor air inlet area, restricting air flow and preventing proper functioning of the engine. Although various screens and filters have been provided for engines, adequate filtration is not available for engines of this type used in high-debris environments.

SUMMARY OF THE INVENTION

The present invention relates to an improved filtering assembly for such engines.

A two-stage air filter is housed within a filter housing that is disposed remotely from the engine. The filter consists of a cylindrical-shaped filter element surrounded by a pre-filter. The pre-filter prevents larger particulate from entering the filter element, while the main filter element removes fine particulates. The pre-filter extends the life of the main filter element at a lower cost. As the pre-filter becomes clogged, it can be easily replaced while the filter element is used for an extended period of time.

The filter housing has a circular exit that is substantially identical in circumference to that of the inlet on a sealed fan housing leading to the cooling fan on the engine. A coupling connects the filter housing to the fan housing. The coupling has elements made of flexible material to dampen vibration during operation of the engine and can be sealed at its ends through the use of annular clamps.

An air induction tube is attached perpendicularly to the coupling by a coupling segment. The air induction tube directs clean air from the filter housing to the carburetor air inlet on the engine.

To further protect the engine, a shield may be strategically placed to prevent materials emitted during the operation of the machine from coming in direct contact with the engine. A thermal sensing device may also be used to read the temperature of the engine and shut down or turn off the engine should the temperature rise beyond a specified limit.

To aid in the maintenance and ultimate protection of the engine, an hour meter may be used to monitor the number of hours that the engine has operated. As a preventative maintenance measure, the hour meter helps the operator to identify the time for replacement of the filter element prior to engine shutdown, thereby reducing strain on the engine due to a heavily clogged filter element.

Other objects, features, and advantages of the invention will be readily apparent from the following description of certain preferred embodiments, in which:

DETAILED DESCRIPTION OF THE DRAWINGS

Figure 1:
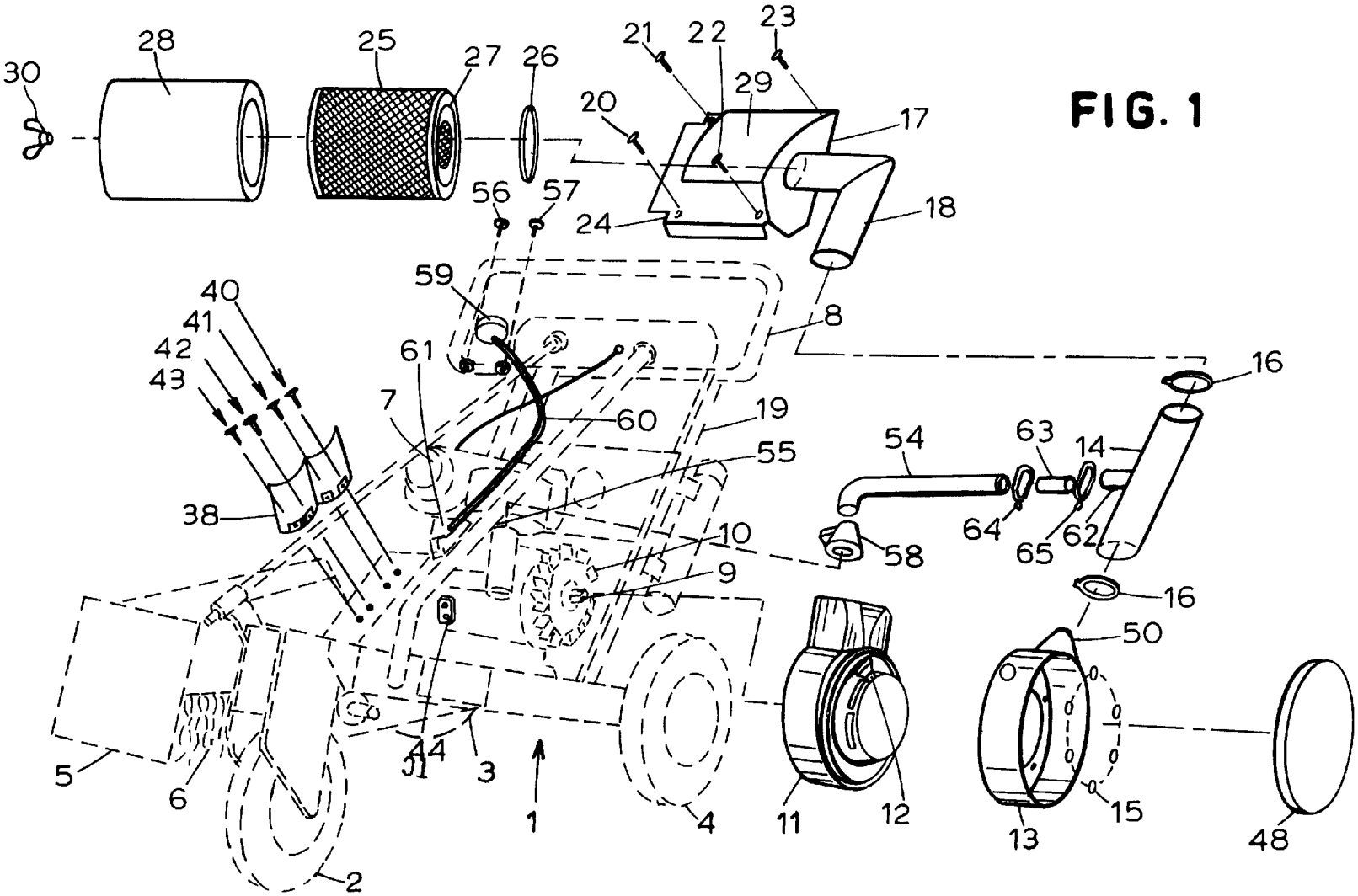
FIG. 1 is an exploded perspective view of an embodiment of a filter assembly in accordance with the present invention.

FIG. 1 illustrates one embodiment of a roofing removal machine 1 in connection with which the invention may be used. Conventionally, the machine moves upon ground wheels 2, 3, and 4, and has cutting blades 6 designed to cut roofing material. A handle 8 is used the steer the machine. The cutting blades 6 are driven by an internal combustion engine 7. The engine 7 has a crankshaft that is attached to and drives a cooling fan 10. The cooling fan 10 draws air to the engine 7 and blows the air over the surface of the engine for cooling. A fan/starter housing 11 covers both the cooling fan 10 and a manual recoil starter 12 that can be used to start the engine 7. A carburetor air inlet 55 is used to provide combustion air to the engine.

Unlike in conventional roof-cutting machines, the machine also has a filter housing 17 that is attached to frame members 19 of the roofing removal machine 1 near the handle 8, remotely from the cutting blades 6. Preferably, the filter housing is disposed at least about two feet from the cutting blades, and at least about two feet above the ground. The filter housing may be attached to the frame members in any conventional way, such as by bolts 20, 21, 22, and 23. As illustrated here, an alignment flange 24 fits between the frame members, assisting in alignment of the bolts.

The filter housing 17 protects a filter comprised of an air filter element 25 and a pre-filter 28 that can be used to provide appropriate low restriction air filtration with structural stability. Disposing these elements within the filter housing protects the filter from normal abuse and environmental conditions. Positioning the filter near the handle 8 facilitates easy servicing. The remote location, elevated above the cutting blades 6, also reduces the load on the filter because particulate matter created during machine operation generally rises only a certain height before returning to the surface level or being carried off by air movement. With the filter located at an elevated level, the amount of particulate matter to be filtered from the air is reduced, extending the useable life of the filter.

Figure 2:
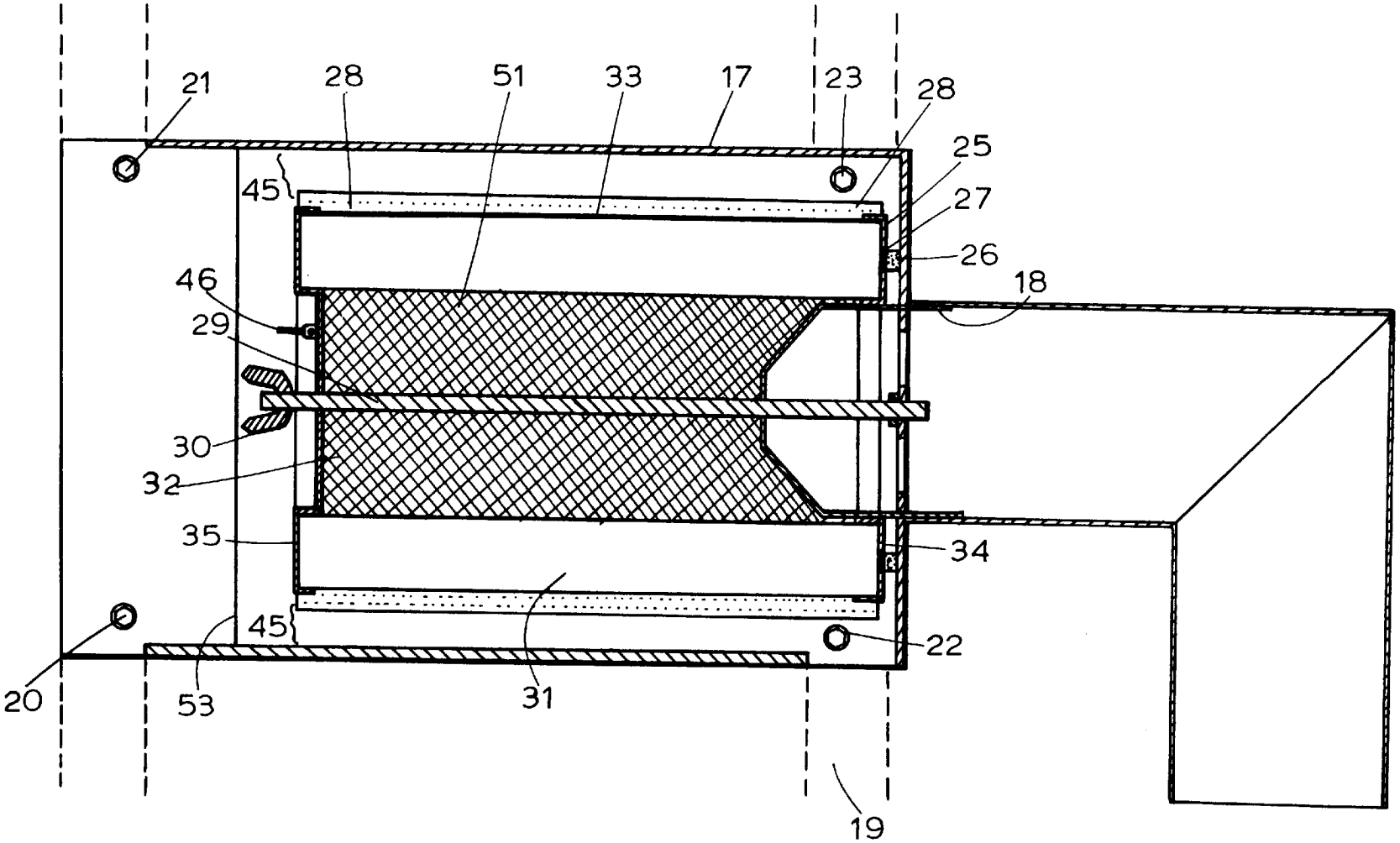
FIG. 2 is an enlarged top cross-sectional view of the filter housing and two-stage filter of the assembly of FIG. 1.
Figure 3:
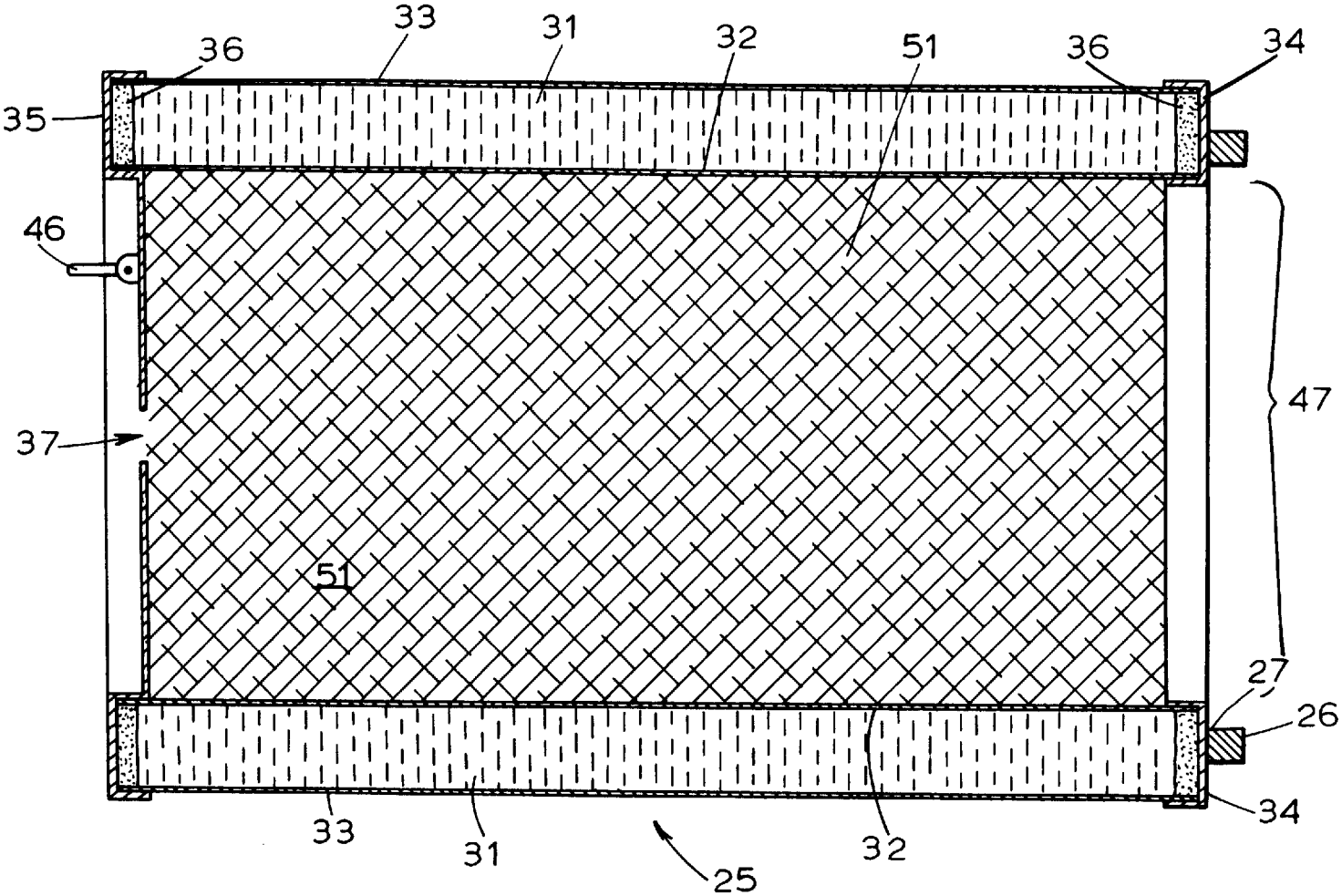
FIG. 3 is a further enlarged sectional view of the filter of FIG. 2.

FIGS. 2 and 3 illustrate the details of the illustrated filter element 25 and pre-filter 28. The filter element includes an inner screen 32 that can be constructed of any conventional screening medium such as plastic, metal, and the like. A pleat pack 31 (also referred to as the filtering medium) constructed of any of a range of conventionally-known filter media is formed in a substantially tubular shape about the inner screen. The pleat pack has accordion folds about its perimeter that extend the full length of the pleat pack 31 to create adjoining filter walls, thereby substantially increasing the filtering area of the pleat pack 31. The outer perimeter of the filter element 25 is supported by an outer screen 33 having a similar but greater circumference than the inner screen 32. The inner screen 32 and outer screen 33 extend the life of the pleat pack 31.

A suitable potting compound 36, such as plastisol, polyurethane, or silicone, is used to secure the ends of the pleat pack 31, the inner screen 32, and the outer screen 33 into both a top end cap 34 and a bottom end cap 35. Both the top end cap 34 and the bottom end cap 35 may be constructed from one or more components using any suitable metal or resin compound. The top end cap 34 includes a discharge port 47 (FIG. 3) from an interior filter chamber 51. An annular-shaped gasket 26 is attached to the top end cap 34 of the filter element 25 with an adhesive material 27.

A replaceable, expandable pre-filter 28 fits over the filter element 25 in a snug friction fit, forcing air to be drawn through the pre-filter 28 prior to entering the filter element 25. The fit between the filter element 25 and the pre-filter 28 is preferably sufficiently snug so that the pre-filter will not move during operation of the machine 1.

The assembly of the filter element 25 and the pre-filter 28 may be removably inserted into the filter housing 17 by sliding the filter element and pre-filter into the filter housing through an open end 53 (FIG.2). Sufficient clearance 45 between the pre-filter 28 and the filter housing 17 permits the desired air flow to the exterior surface of the pre-filter. When seated properly, the discharge port 47 (FIG. 3) from the interior filter chamber 51 is in fluid communication with an exit tube 18 (FIG. 2) on the filter housing 17.

A hole 37 in the bottom end cap 35 (FIG. 3) enables the filter element 25 to be securely mounted to a threaded yoke 29 (FIG. 2) in the filter housing 17. In the illustrated embodiment of the invention, the yoke projects through the hole when the filter element is seated properly, and a wingnut 30 may be threaded over the end of the yoke 29 to secure the filter element in position. Tightening the wingnut 30 onto the yoke 29 compresses the gasket 26 on the top end cap 34 against the filter housing, creating an air-tight seal that prevents air from passing through the open end 53 of the filter housing to the exit tube 18 without first passing through the pre-filter 28 and the filter element 25.

For replacing a dirty filter element or pre-filter, a pull ring 46 on the bottom end cap 35 provides a simple means for removing the filter element 25 and the pre-filter 28 from the filter housing 17 after the wingnut 30 is removed.

As illustrated in FIG. 1, a sealed fan housing 13 and a coupling 14 place the filter housing 17 in fluid communication with far/starter housing 11 and the cooling fan 10, creating a sealed system.

As illustrated, the coupling 14 is a flexible tube, with a uniform cross-sectional area across its length and a smaller circular perpendicular branch 62 that protrudes near its mid-section. The coupling has one end that is designed to mate with the exit tube 18 on the filter housing 17. The coupling is sealed to the exit tube by an annular clamp 16.

The other end of the coupling 14 is attached to the fan housing 13. The fan housing is attached to the fan/starter housing 11 on the engine 7 by a standard bolt/nut arrangement 15, and serves to collect and direct air to the cooling fan 10. As illustrated, the fan housing covers the recoil starter 12. Access to the recoil starter is preserved through the use of a removable cover 48.

The fan housing 13 has an inlet side opening 50 that provides air to the cooling fan 10 when the machine is in use. Preferably, the inlet side opening is configured in the same way as the exit tube 18 on the filter housing 17, enabling the end of the coupling 14 to be secured to the inlet side opening in the same way. As illustrated, the coupling is slipped over the inlet side opening and secured with another annular clamp 16. The flexibility of the coupling facilitates connection despite alignment errors, and dampens vibrations while the engine is operating.

The branch 62 on the coupling 14 is used to direct clean air from the filter housing 17 to the carburetor air inlet 55. The branch 62 is tubular in shape and protrudes from the coupling toward the engine 7. An air induction tube 54 extends from the branch to the carburetor air inlet. The air induction tube is made of a flexible material to dampen vibration caused by operation of the engine. As illustrated, the air induction tube is connected to the branch by a rigid short coupling tube 63 that has an outside diameter that is substantially the same as the inside diameter of both the air induction tube and the branch. A clamp 64 secures the air induction tube over one end of the short coupling tube, while a clamp 65 secures the branch over the other end of the short coupling tube. The other end of the air induction tube 54 is connected to the carburetor inlet 55 by a carburetor clamp 58, which is contoured and sufficiently flexible to enable a sealed connection.

Alternatively, the coupling 14 could include a flexible tube section or one or both sides of a rigid branch. In such an arrangement, the air induction tube 54 could be attached to the branch with a single clamp. Another equivalent alternative would be to form the coupling 14 of a series of series of connected parts: for example, a tube connecting the fan housing 13 to a short coupling tube that is in turn connected to a branch on a flexible tube extending from the filter housing 17 to the carburetor air inlet 55. This would be the equivalent of connecting the lower end of the coupling 14 illustrated in FIG. 1 to the carburetor air inlet, rather than to the fan housing 13, and connecting the lower end of the illustrated air induction tube 54 to the fan housing.

A shield 38 (FIG. 1) designed for easy removal and cleaning may be attached to a cutting blade guard 39 on the engine 7 with four bolts 40, 41, 42, and 43. The shield minimizes the extent to which roofing material deposits adhere to the engine 7 during operation of the cutting blades 6.

A thermal sensing device 44 may be connected to the cylinder head and spark plug of the engine 7. The thermal sensing device monitors the temperature of the engine and shuts down or turns off the engine if the temperature elevates beyond a specified temperature, reducing the potential for engine failure.

An hour meter 59 may be attached to the handle 8 of the machine with two bolts 56 and 57. An electrical signal line 60 connects the hour meter 59 to the engine magneto 61 at the opposing end. Engine operation hours are conveyed and indicated on the hour meter 59, enabling the operator to change out the filter element 25 prior to maximum contamination and engine shutdown.

Modifications and alternative embodiments of the invention will be apparent to those skilled in the art, without departing from the spirit of the invention.

We claim:

1. A filter assembly for cleaning air for engines, the assembly comprising:

a fan housing comprising means for collecting and directing air flow to a cooling fan on an engine;

a filter housing with means for securing the filter housing on a machine, remote from the engine;

a coupling linking the fan housing to the filter housing;

a tube connecting the coupling to a carburetor air inlet on the engine; and a filter disposed within the filter housing.

2. A filter assembly in accordance with claim 1, in which the coupling is flexible and has a uniform cross-sectional area across its length, and has a branch leading to the tube to the carburetor air inlet.

3. A filter assembly in accordance with claim 1, in which the fan housing has an inlet side opening with the same circumference as an exit tube on the filter housing.

4. A filter assembly according to claim 1, in which the coupling comprises means for correcting imperfections in alignment between the filter housing and the fan housing and the carburetor air inlet.

5. A filter assembly in accordance with claim 1, in which an annular gasket is disposed between the filter housing and the filter.

6. A filter assembly in accordance with claim 1, in which the filter comprises a pleated media potted into an endcap and covered with a replaceable pre-filter.

7. A engine assembly in accordance with claim 1, in which the filter has a pull ring.

8. An engine filter assembly according to claim 1, and further comprising a thermal sensing device comprising means for sensing the temperature of a cylinder head of an engine and for shutting down the engine when the temperature of the cylinder head rises to a specified temperature.

9. A filter assembly according to claim 1, in which the fan housing comprises means for providing sealable access to a recoil starter.

10. A filter assembly according to claim 1, in which the filter housing is made of carbon steel.

11. A filter assembly in accordance with claim 1, and further comprising a shield with means for mounting the shield to a guard on an engine and for protecting the engine from debris raised by operation of the engine.

12. A filter assembly in accordance with claim 1, in which the filter comprises a separately-replaceable pre-filter.

13. A filter assembly in accordance with claim 1, and further comprising a meter connected to the engine comprising means for indicating the length of service of the engine.

14. A filter assembly in accordance with claim 1, in which the coupling comprises a branch that protrudes from the coupling toward the engine.

15. A filter assembly in accordance with claim 1, in which the coupling is connected to the tube to the carburetor air inlet by a short coupling tube.

16. A machine including the engine filter assembly of claim 1.

17. A cutting machine comprising:

an engine with a cooling fan and a carburetor air inlet;

a handle remote from the engine;

cutting blades mechanically connected to the engine;

a fan housing comprising means for restricting air flow to the cooling fan;

a filter housing disposed near the handle;

a means for placing the fan housing and the carburetor air inlet in fluid communication with the filter housing; and a filter disposed within the filter housing.

* * * * *